United States Patent [19]

Natvik et al.

[11] 4,019,973

[45] Apr. 26, 1977

[54] CRUST-BREAKING MACHINE

[75] Inventors: Rolf Natvik, Ovre Ardal; Rolf Rådahl, Rakkestad, both of Norway

[73] Assignee: A/S Ardal og Sunndal Verk, Oslo, Norway

[22] Filed: Dec. 18, 1975

[21] Appl. No.: 641,924

[30] Foreign Application Priority Data

Aug. 27, 1975 Norway ..... 752948

[52] U.S. Cl. ..... 204/194; 204/243 R

[51] Int. Cl.[2] ..... C25D 21/00; C25D 21/12

[58] Field of Search ..... 204/243 R, 244–247, 204/194

[56] References Cited

UNITED STATES PATENTS 3,616,440 10/1971 Forberg ..... 204/245

FOREIGN PATENTS OR APPLICATIONS 193,619 2/1957 Austria ..... 204/243 R 364,361 10/1962 Switzerland ..... 204/243 R 1,017,163 1/1966 United Kingdom ..... 204/243 R

*Primary Examiner*—T. M. Tufariello

*Attorney, Agent, or Firm*—Wenderoth, Lind & Ponack

[57] ABSTRACT

A crust breaking machine includes a self-propelled carriage having front wheels and rear wheels, a crust-breaking tool of the continuously breaking type mounted on the carriage, and an arm provided on the carriage and adapted to support the tool. This arm is mounted for swinging movement in the vertical plane and in the horizontal plane, with a mounting located between the front and rear wheels and in front of the driver's seat seen in the normal driving direction of the machine during crust-breaking. Thus the tool can be brought into a working position on each side of the carriage and into a rest position in front of the carriage.

4 Claims, 3 Drawing Figures

CRUST-BREAKING MACHINE

BACKGROUND OF THE INVENTION

In the production of aluminum by electrolysis in a molten bath of $Al_2O_3$ being dissolved in molten cryolite, a crust is formed on the surface of the electrolytic bath. This crust must be broken and pushed down into the molten electrolyte in order to promote the process of electrolysis.

The present invention relates to a crust-breaking machine for the above purpose, this machine being of the type which comprises a self-propelled carriage having front and rear wheels, a crust-breaking tool of the continuously breaking type mounted on the carriage, and an arm provided on the carriage and adapted to carry the tool. The term crust-breaking tool of the continuously breaking type is herein intended to refer to either a freely rotatable tool in the form of a wheel having a set of radially projecting rods, or a plough-like tool. Both these embodiments of a continuously breaking tool are described in U.S. Pat. No. 3,306,668.

As is known, common electrolytic cells are usually rectangular. The cells are arranged either end to end or side by side, and usually several cells are arranged in rows inside a furnace hall. Between each row there is a driving lane. The crust on the electrolytic bath is broken either at substantially fixed points of time, for example 5 – 15 times a day ("round breaking") or when the cell voltage has increased because of lack of $Al_2O_3$ in the electrolyte ("breaking upon anode effect").

When the cells are placed end to end the crust is usually broken at the longitudinal side of the cell, but when the cells are placed side by side, the crust may be broken either at the longitudinal side or at the short side. In order to secure a smooth operation the crust is usually broken every second time at one side and every second time at the other side of the cell. When the crust is broken as "round breaking" the carriage usually starts at one end of a row and breaks the crust on most of the cells while driving towards the other end of the row. When the crust is broken "upon anode effect", this usually takes place at a point of time which is not determined beforehand, and an anode effect condition can occur at one end of the row whereas the following anode effect condition can occur at the other end of the same row, or it may occur on another row.

In the carriages employing a crust-breaking tool as described in U.S. Pat. No. 3,306,668 the arm assembly can only be swung in a vertical plane transversally to the longitudinal direction of the carriage. In this way the crust-breaking tool can only work at one side of the carriage.

When the crust is broken as "round breaking" it is desired for safety reasons that the carriage shall always have the same driving direction, i.e. it shall always be driven either forwardly or backwardly. With the arm arrangements having existed hitherto, this results therein that when it is desired to break the crust at one side of the cell, one starts at one end of the row, whereas when it is desired to break the crust at the other side of the cell, one has to start at the other end of the row. In this way the crust on the cells being at the middle of the row can be broken at a fixed point of time, whereas on the cells being located at the ends of the row, the crust will be broken either a little earlier or a little later than desired.

SUMMARY OF THE INVENTION

An advantageous solution to this problem is obtained with the present invention in that the arm to which the crust-breaking tool is attached, can be moved both in the vertical plane and in the horizontal plane. By making the arm movable in the horizontal plane it is possible to move the crust-breaking tool to a working positions at either side of the carriage. In this way it is possible when breaking the crust as round breaking always to start at the same end of a row, since the crust on one side of the cell can be broken with the crust-breaking tool for example on the right side of the carriage, and on the other side of the cell with the crust-breaking tool on the left side of the carriage. Accordingly, the crust on the cell can be broken at fixed time intervals and thereby it is obtained that the supply of $Al_2O_3$ to the molten electrolyte will be as uniform as possible.

An anode effect condition in the cell usually occurs at completely indefinite times and therefore it is not possible to have any fixed routine for the time at which this type of crust-breaking shall be carried out. The situation therefore often arises that whereas the anode effect condition for which the crust has just been broken, was for example on the right side of the carriage, the following anode effect condition occurs to the left side of the carriage. With the arm arrangements used so far it has been necessary in such cases to turn the carriage 180° in order to put the crust-breaking tool in a correct position. With the relativley narrow driving lanes which usually exist between the cell rows, this is difficult and takes a comparatively long time.

An advantageous solution also to this problem is obtained with the present invention in that the arm assembly can be swung in the horizontal plane so that the crust-breaking tool will have a working position on each side of the carriage, so that instead of having to turn the carriage 180°, the arm is swung from one to the other side of the carriage. In this way the time elapsed before breaking the crust on the cell having an anode effect condition, will usually be reduced.

Reducing the time during which the cell has an anode effect condition has a double significance, since the cell produces little when there is an anode effect condition, at the same time as the cell will be hotter because of the large energy dissipation during an anode effect condition, which is also disadvantageous to production. The fact that the crust in connection with an anode effect condition is quickly broken, in other words will increase production and save energy. This will also reduce the escape of fluorine from the electrolytic bath, since the cell will remain a shorter time with open surface, which in this connection is particularly unfavourable. Reduced escape of fluorine will be an advantage both with respect to the working atmosphere around the cell and for the environment surrounding the electrolytic plant.

In cases where there is employed a long supporting arm for the, tool the weight of the tool will easily give the carriage a high center of gravity location in the inactive position of the tool, in arrangements where the tool is swung to a position above the carriage, and thereby the risk of turning over of the carriage can easily arise. In cases where there is employed a supporting arm having a variable length (telescopic arm) or an arrangement with articulate arms, the tool in its inactive position easily will give the carriage a center of gravity which is located substantially to the side of the longitudinal axis of the carriage. This, among other things, involves difficulties in locating the weight of the carriage in a satisfactory way. In addition to the above, there will also in practice be certain disadvantages with respect to maneuvering. Also, with the tool in the inactive position the view from the driver's seat will be restricted to a substantial degree.

An advantageous solution to these problems has been obtained with the present invention in that the arm assembly can be swung in the horizontal plane to a position such that the axis of the supporting arm with the breaking tool will be substantially coincident with the longitudinal axis of the carriage. In this way the weight of the supporting arm and the tool will be evenly divided between each side of the carriage. At the same time the breaking tool is elevated in the vertical plane to a very small degree, so that the tool to a very small degree restricts the view from the driver's seat.

According to the above and as more closely stated in the patent claims, what is novel and particular in the crust-breaking machine according to the invention, is that the arm is mounted for swinging movement in the vertical plane and in the horizontal plane, with a mounting located between the front and rear wheels and in front of the driver's seat seen in the normal driving direction of the machine during crust-breaking, so that the tool can be moved into a working position on each side of the carriage and into a rest position in front of the carriage.

According to a particular embodiment of the invention there is provided a supporting cradle for the arm in the working positions on each side of the carriage. This represents a very significant construction in practice because the forces acting on the arm during work do not lead to substantial strains in the supporting system for the arm, including movement mechanisms and hydraulic or pneumatic components.

BRIEF DESCRIPTIONS OF THE DRAWINGS

Additional features and advantages associated with the crust-breaking machine according to the invention will appear from the following description of an embodiment thereof with reference to the accompanying drawings, in which:

FIG. 1 schematically shows in elevation a crust-breaking machine according to the invention seen from the side and with the crust-breaking tool being in a rest position in front of the machine, FIG. 2 is a front view of the machine in FIG. 1, but with the tool in a working position at one side of the machine, and FIG. 3 is a plan view of the crust-breaking machine in FIGS. 1 and 2 with portions of the arm and the tool cut away.

DETAILED DESCRIPTION OF THE INVENTION

Figure 1:
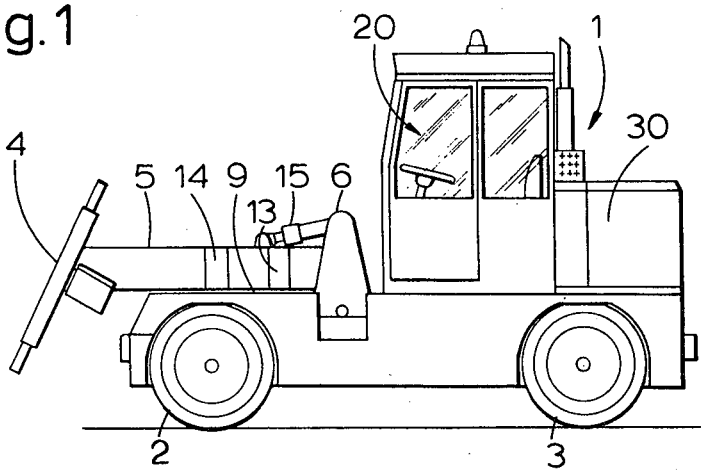

The illustrated exemplary embodiment of a crust-breaking machine according to the invention is generally constructed as a carriage 1 having front wheels 2 and rear wheels 3, and driver's seat 20 having control and operating devices, and a motor 30 located above the rear wheels 3 which in this case are also driving wheels. The steering of the carriage 1 takes place by means of the front wheels 2. It is obvious, however, that the steering can take place with any of the wheel pairs, possibly by means of both wheel pairs simultaneously. Moreover, it is obvious that the terms "front wheels" 2 and "rear wheels" 3 must not be regarded as binding, but only indicates which driving direction will normally be natural in view of the arrangement of the driver's seat 20 with cabin, windows etc.

A crust-breaking wheel 4 of the type which is provided with radial rods as described in U.S. Pat. No. 3,306,668, is freely rotatably mounted at the free end of an arm 5. By means of a mounting in the form of a short vertical column 6 the arm 5 with the tool 4 can be swung both in the horizontal plane and in the vertical plane. The column 6 can be turned about a vertical axis 18 by means of a drive arrangement 17 comprising for example a hydraulic motor and a toothed wheel rim at the foot of the column 6. For swinging the arm 5 in the vertical plane, arm 5 is mounted on a pivot 16 in the column 6 and is moved by means of a hydraulic or pneumatic cylinder 15.

As shown in the drawing the arm 5 can be swung about 180° in the horizontal plane, so that the tool 4 selectively can be brought into a working position at either side of the carriage 1. The swinging or angular movement of the arm 5 in the vertical plane does not normally have to be so large, and the amount of this movement is dependent, inter alia, on the specific design of the front part of the carriage 1.

Figure 2:
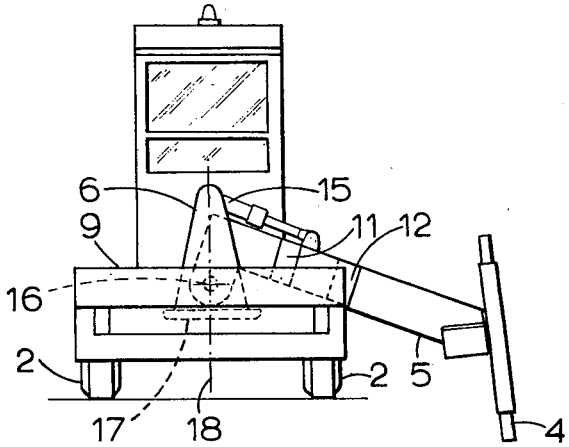
Figure 3:
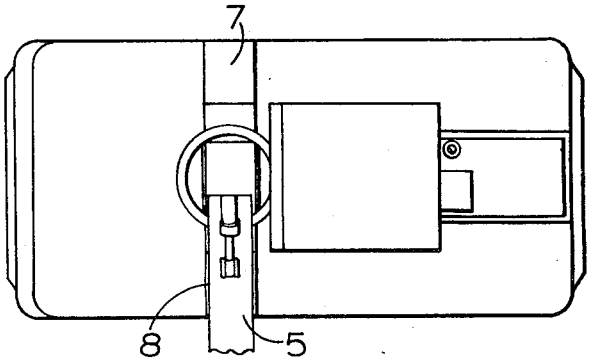

As will appear in particular from FIGS. 1 and 2 the front part of the carriage 1 is designed with a generally horizontal platform 9 which is free of structural members projecting upwardly therefrom and which consequently permits a lowest possible movement of the arm 5 with the tool 4 from one working position to the other or to and from a rest position in front of the carriage. In this connection it is of significance that the platform 9 is at a low level above the upper portion of the front wheels 2. With regard to the platform 9 it is of course not absolutely necessary that the same be formed by a completely continuous surface or the like, but the essential point is that the forward upper part of the carriage 1 does not have any structural members projecting upwardly therefrom, which might require lifting of the arm 5 with the tool 4 to an unnecessarily large height during work and driving. This consideration has essential significance for safety, in particular because the driver of the machine with the structure according to the invention will have an especially good view of the driving and working area without being hindered to any noticable degree by the arm arrangement. This applies both to the working position of the tool to the side of the carriage, and to the rest position of the tool in front of the carriage.

A very essential feature of the illustrated embodiment that there are provided supporting cradles 7 and 8 at each side of the column 6 for accommodating the arm 5 in the working positions thereof. These supporting cradles have the form of channels which run at an inclination downwardly to each side below the level of the platform 9. The side walls of these supporting cradles are provided with engagement areas adapted to sustain horizontal forces from the arm 5. As shown specifically in FIGS. 1 and 2 the arm 5 is also provided with wear or supporting plates 11 – 14 adapted to cooperate with the engagement areas in the supporting cradles. With these supporting cradles, not only are the column 6 with the drive arrangement relieved of stresses during work with the tool 4, but also the lowest possible position of the arm 5 between the wheel pairs 2 and 3 is obtained during the machine's work.

We claim:

1. A crust-breaking machine comprising:

a self-propelled carriage having front wheels, rear wheels and a driver's seat;

a column mounted on said carriage at a position between said front and rear wheels and in front of said driver's seat;

a support arm connected at a first end thereof to said column;

a crust-breaking tool of the continuously breaking type supported at a second end of said support arm;

means, connected to said support arm, for selectively moving said support arm and said crust-breaking tool in a vertical plane;

means, operatively connected to said column, for selectively rotating said column about a vertical axis and for thereby moving said support arm and said crust-breaking tool in a horizontal plane between first and second working positions on opposite lateral sides of said carriage and a rest position extending forwardly of said carriage; and support cradle means, positioned at each of said first and second working positions, for supporting said support arm and transferring stresses imparted thereto by said crust-breaking tool to said carriage while reducing transfer of such stresses to said column.

2. A machine as claimed in claim 1, wherein said support cradle means each have engagement areas; and further comprising supporting plates on said support arm, said plates contacting said engagement areas of the respective said support cradle means when said arm is positioned in the respective said first and second working positions.

3. A machine as claimed in claim 1, wherein each of said support cradle means extends downwardly and laterally outwardly from said carriage.

4. A machine as claimed in claim 1, wherein said carriage has a forward horizontally extending surface positioned slightly above said front wheels, said surface being free of obstructions extending upwardly therefrom, and said surface being positioned forwardly of said column.

* * * * *